United States Patent [19]

Berelson

[11] 4,441,867

[45] Apr. 10, 1984

[54] PERISTALTIC PUMP

[76] Inventor: Rudolph Berelson, Treelawns, 34 Fallowfield, Stanmore Hill, Stanmore, Middlesex, England

[21] Appl. No.: 361,592

[22] Filed: Mar. 25, 1982

[30] Foreign Application Priority Data

Oct. 20, 1981 [GB] United Kingdom ..... 8131573

[51] Int. Cl.[3] ..... F04B 43/12; F04B 45/08

[52] U.S. Cl. ..... 417/475; 417/477

[58] Field of Search ..... 417/475, 476, 477, 319; 222/214

[56] References Cited

U.S. PATENT DOCUMENTS

| | | | |
|---|---|---|---|
| 419,461 | 1/1890 | Lee | 417/477 |
| 2,018,999 | 10/1935 | DeBakey et al. | 417/477 |
| 3,832,096 | 8/1974 | Gelford | 417/475 |
| 3,951,570 | 4/1976 | DeBiaggi | 417/475 X |
| 4,070,725 | 1/1978 | Austin | 417/477 X |

FOREIGN PATENT DOCUMENTS

| | | | |
|---|---|---|---|
| 340775 | 1/1978 | Austria . | |
| 427746 | 4/1926 | Fed. Rep. of Germany . | |
| 1467661 | 3/1977 | United Kingdom . | |
| 1528509 | 10/1978 | United Kingdom . | |
| 1568940 | 6/1980 | United Kingdom . | |
| 2051253 | 1/1981 | United Kingdom | 417/477 |

*Primary Examiner*—Richard E. Gluck

*Attorney, Agent, or Firm*—Cesari and McKenna

[57] ABSTRACT

To permit two different fluent media to be pumped independently of each other in one and the same peristaltic pump, a single reversible motor 3 is connected to at least two rotors 7,8 respectively passing over an associated separate resiliently compressible tube 12, 13, a first of said rotors 7, being effective to compress its associated tube 12 only when the motor 3 is turning in one direction 34 and a second of said rotors 8 being effective to compress its associated tube 13 only when the motor 3 is turning in the opposite direction.

6 Claims, 7 Drawing Figures

PERISTALTIC PUMP

The invention relates to a peristaltic pump.

A peristaltic pump is one in which flow is produced by alternating contractions and relaxations, usually by rollers successively compressing a length of resilient tube connected to a source of fluent material to be pumped. In the most commonly encountered construction, the tube is located on an arcuately curved support concentric with a rotor which is driven by an electric motor and comprises two, or sometimes more, rollers for successively compressing the tube as the rotor is turned. Each roller makes rolling contact with the tube and flattens the tube against the curved support at the point of contact. The point of contact, and hence the flat in the tube, advances along the curved support as the rotor turns, whereby the tube contents are pushed along in front of the flat. Behind the roller, the tube relaxes again to take in more fluent material under suction. Before one roller has reached the end of the arc of the curved support and ceases to compress the tube, the other or next roller on the rotor is in a position adjacent the beginning of the arc of the support to flatten the tube again. The rate of flow depends on the speed of the motor, and consequently the rotor, and the internal size of the tube.

One of the most important advantages of peristaltic pumps is that there is no contact between the pump parts and the fluent medium conducted in the tube. Peristaltic pumps have therefore found numerous applications for pumping liquids, gases, and even viscous slurries or pastes in laboratories, hospitals as well as industry. For example, in the case of so-called on-premise laundries using caustic and/or acidic detergents, groups of four peristaltic dispensing pumps are operated intermittently to feed metered quantities of four different liquid detergents to a washing machine at predetermined times. The pumps are electronically time controlled. An electric signal operates the motor of the appropriate pump whenever detergent is required to be fed from the associated tube. A disadvantage experienced with groups of pumps is, however, that each pump requires its own electric motor and rotor, which is expensive and takes up space. If a single pump were to work on two or more tubes instead of just one, the liquid in both or all tubes would be fed simultaneously, which is usually not desired.

GB-PS No. 1,467,661 suggests that the problem of simultaneous pumping in the tubes of two separate peristaltic pumps driven by a common motor be overcome by the provision of electromagnetic clutches, or using a reversible motor connected to the pumps by separate drive couplings incorporating clutches which engage in only one direction of rotation. However, added to the cost of two separate pumps, the provision of clutches becomes unviable for most applications because a separate electric motor for each pump would then be cheaper.

In GB-PS No. 1,528,509, a uni-directional motor drives a rotor which is common to several tubes of a peristaltic pump. Simultaneous pumping in all the tubes is avoided by providing each tube firstly with a separate backing member which is movable out of engagement with the rotor and secondly with a separate pair of movable push rods which pinch the tube shut. Again, the expense caused by the complexity of such a construction and of the means for operating the individual backing members and push rods and selecting which are to be operated prohibits the use of this pump for most applications.

The invention aims to provide a peristaltic pump which permits two different fluent media to be pumped independently of each other.

According to the invention, a peristaltic pump comprises a single reversible motor operatively connected to at least two rotors respectively passing over an associated separate resiliently compressible tube when the motor is on, wherein each rotor comprises two or more rollers and the rollers of each rotor are retractable, the construction being such that the rollers of a first rotor are extended and those of a second rotor retracted when the motor is turning in one direction, and vice versa when the motor is reversed.

By means of the invention, both the first and second rotors can be turning, no matter in which direction the motor is running, but only one of these rotors is compressing its associated tube while the other is idling, i.e. while the other is leaving its associated tube uncompressed. Consequently, the reversibility of the motor permits independent control of the pumping action in the tubes associated with the first and second rotors. In addition, there is a marked economy in constructional costs and size.

In a preferred form of the invention, the rollers can be automatically retractable and the use of biassing springs can be avoided if each rotor comprises a carrier which is adapted to be mounted on the motor output shaft and of which the rollers are individually mounted for rotation in separate roller mountings which are pivoted to the carrier, co-operating stops being provided on the carrier and each roller mounting to limit the pivotal movement of the roller mountings.

One example of the invention is illustrated in the accompanying diagrammatic drawings, wherein.

Figure 2:
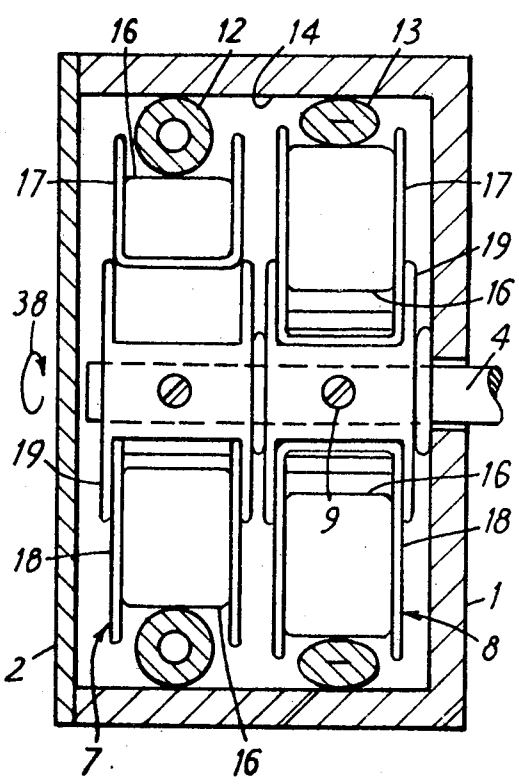
FIG. 2 is a fragmentary similar view of the FIG. 1 pump but showing the conditions of its rotors and tubes when the motor is turning in the reverse direction.

The illustrated peristaltic pump is designed to pump two liquids independently in two separate tubes. It comprises a pump housing 1 and cover 2 screw-connected to a reversible electric motor 3 (FIG. 1) which has an output shaft 4 extending into the housing and supports 6 for locating and supporting the housing thereagainst. The motor output shaft 4 carries two rotors generally designated 7 and 8 which are clamped to it by screws 9 which, when tightened, engage a flat 11 on the shaft 4.

Two lengths of tubes 12 and 13 associated with the respective rotors 7 and 8 and connected to respective supplies (not shown) for the two liquids to be pumped and to points of delivery (not shown) for the liquids enter and leave the pump housing 1 through apertures therein and may be clamped to the housing by any suitable means such as collars or clips (not shown)

which do not unduly squeeze the tubes. The arrangement is such that portions of the lengths of the tubes 12, 13 disposed within the housing 1 lie adjacent an arcuate support or backing 14 defined in the housing. After assembly, the shaft 4 is substantially at the centre of curvature of the support 14. Instead of being formed in the housing 1, the support 14 may be in the form of a separately fabricated track or tracks inserted in the housing.

Each of the rotors 7,8 comprises a pair of rollers 16 for passing over the appropriate tube 12 or 13, a pair of mountings 17, 18 (one for each roller 16) in which the rollers are mounted for rotation and a carrier 19 for the roller mountings 17.

Figure 4:
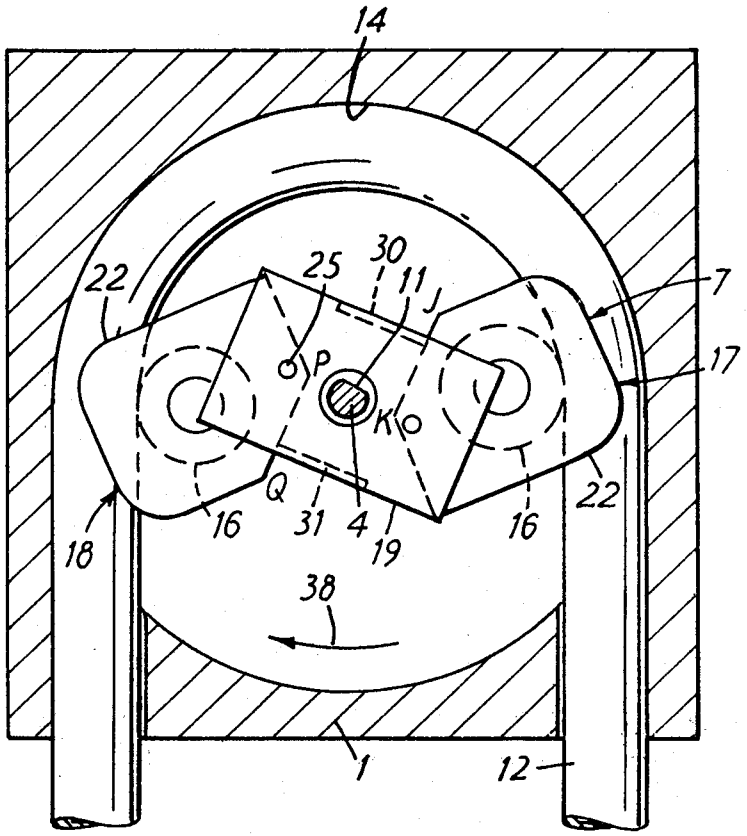
FIG. 4 is a view similar to FIG. 3 but showing the same rotor and tube during idling, and FIGS. 5 to 7 together constitute an enlarged exploded perspective view of one of the rotors of the previous figures without the rollers and pivot pins, FIG. 5 showing one of the roller mountings, FIG. 6 the carrier and FIG. 7 the other roller mounting.
Figure 3:
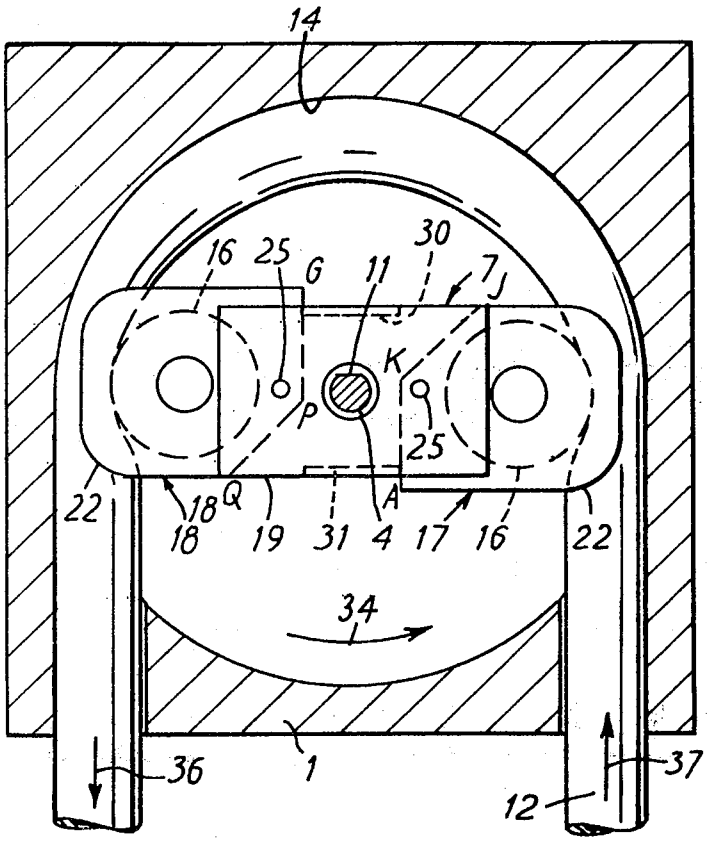
FIG. 3 is a part-sectional end view of the pump showing one of the rotors and its associated tube during pumping.
Figure 5:
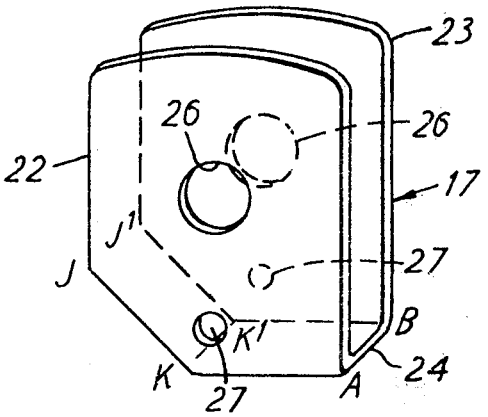
Figure 7:
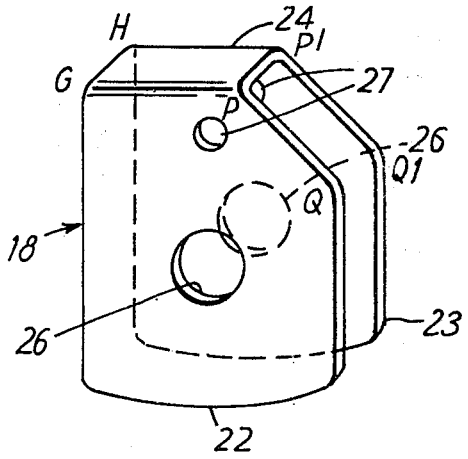

Referring to FIGS. 5 and 7, where the rollers have been omitted for clarity, the mountings 17, 18 are identical and can be made from sheet metal. Each roller mounting is in the form of a substantially U-shaped channel defining two parallel limbs 22, 23 interconnected by a web 24. At one end of the channel, the limbs 22, 23 are chamfered, as indicated by the oblique edges J–K and J1–K1 in FIG. 5 and P–Q, P1–Q1 in FIG. 7, the web or channel base terminating at the edges K–K1 and P–P1, respectively. The chamfered edges and web constitute stops on the roller mounting to be referred to hereinafter. Although the top limb edges in FIG. 5 and bottom limb edges in FIG. 7, i.e. the edges defining the mouth of each channel, are shown as being continuously curved, they may be straight as shown in FIGS. 3 and 4, with only the corners rounded off to provide adequate clearance with respect to the arcuate support 14.

Figure 1:
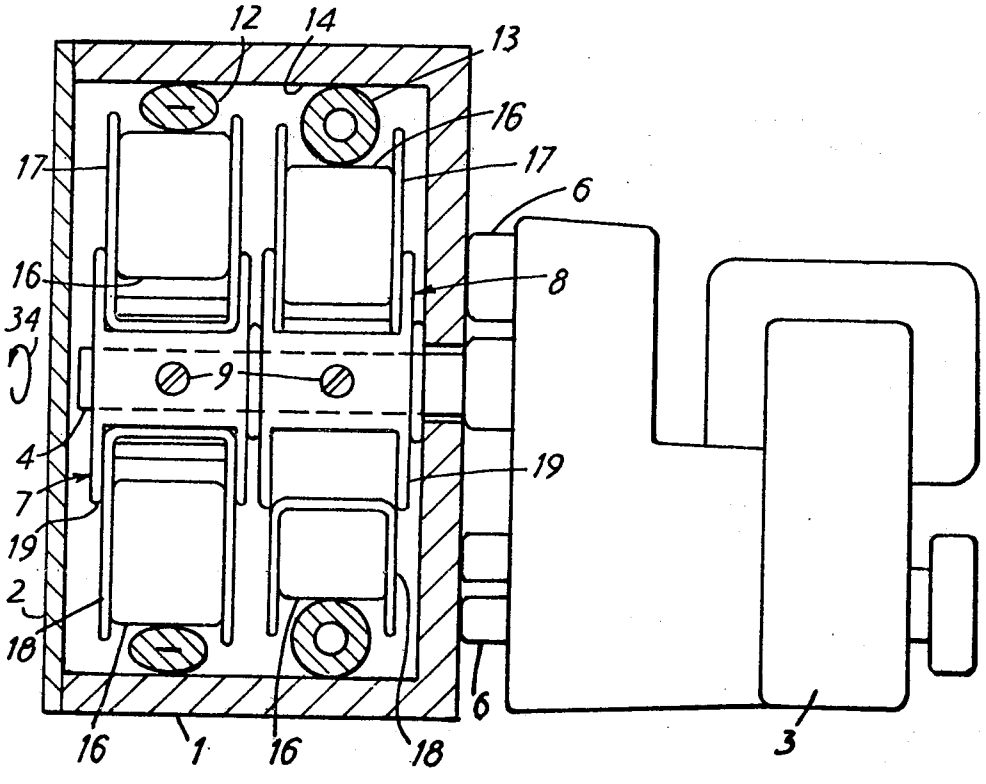
FIG. 1 is a part-sectional side elevation of a peristaltic pump.

The limbs 22, 23 are provided with aligned holes 26 for a roller axle (not shown in FIGS. 5 and 7) and aligned apertures 27 for pivot pins 25 (FIGS. 3 and 4) which serve to hinge each roller mounting to the carrier 19. The lengths of the channel limbs are chosen not only so as to be well clear of the support 14 in the housing 1 at all rotary positions of the rotor but, as best seen in FIGS. 1 and 2, also so as to extend beyond the diameters of the rollers 16 and straddle the tube 12 or 13.

The carrier 19 can also be shaped from a sheet metal blank and is formed by two parallel rectangular plates 28 having aligned pairs of apertures 29 for receiving the aforementioned pivot pins 25 and they are spaced apart by cross-members 30, 31 at the opposed longer sides. The cross-members constitute stops on the carrier for co-operating with the aforementioned stops on the roller mountings as will hereinafter be explained. The plates 28 have aligned holes 32 so that the carrier can be pushed onto the motor output shaft 4 and the cross-member 31 contains a tapped hole 33 for receiving the aforementioned clamping screw 9. The roller mountings are pivoted to the carrier 19 so that the chamfered edges of the mounting 17 can co-operate with the cross-member 30 and the chamfered edges of the mounting 18 can co-operate with the cross-member 31 as will also be described hereinafter. When connected to the carrier 19, the roller mountings are disposed between the plates 28 of the carrier and pivotable with respect thereto within limits defined by the stops.

The rotors 7, 8 are constructed and assembled in identical manner but, for reasons that will beome apparent hereinafter, they must be placed on the motor output shaft 4 in opposite senses, that is to say if one rotor has the oblique edges on its roller mountings facing in the clockwise direction of rotation of the shaft 4, the corresponding edges on the other rotor must face in the anti-clockwise direction.

The principle of operation of a peristaltic pump will first be briefly explained with reference to FIG. 3. As the motor output shaft 4 is turned in the direction of the arrow 34, the rollers 16 successively make rolling contact with the tube 12 and flatten the tube against the curved support 14 at the point of contact. This point of contact, and consequently the flat in the tube, advances along the curved support 14 as the rotor 7 is turned, whereby the tube contents are pushed along in front of the flat in the direction of the arrow 36. Behind each roller 16, the tube relaxes again to take in more fluent material under suction in the direction of the arrow 37. Before one roller 16 has reached the end of the support 14 and ceases to compress the tube, the next roller 16 of the rotor 7 is in a position adjacent the beginning of the arc of the support 14 to flatten the tube 12 again. If the rotor 7 were to be a rigid integer as has hitherto been conventional and its direction of rotation were to be reversed, pumping of the liquid in the tube 12 will take place in the direction opposite to the arrows 36 and 37, i.e. the liquid would be taken back from the point of delivery and returned to the source which, of course, is not desired. Accordingly, when providing two rotors on the motor output shaft as in the present invention, with a separate tube associated with each rotor, it is not possible to achieve independent liquid flow in the tubes solely by reversing the direction of rotation unless steps are taken to ensure that the rollers of one of the rotors disengage the tube in each direction of rotation.

Figure 6:
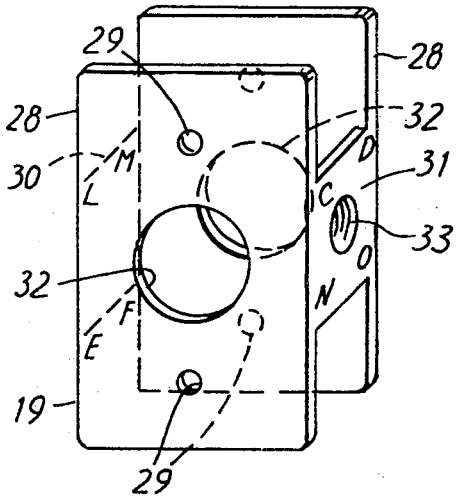

Considering the rotor 7 associated with the tube 12, when the motor shaft 4 turns anti-clockwise as indicated by the arrow 34 in FIG. 3 then, referring to FIGS. 5 to 7, the edge C–D of the cross-member or stop 31 of the carrier 19 will, at a position near the edge A–B of the mounting 17, come to abut against the base A–B–K1K, i.e. the web or stop 24, of the channel defined by the roller mounting 17, and the edge E–F on the cross-member or stop 30 will, near the edge G–H, abut against the base G–H–P1–P or web 24 of the channel defined by the roller mounting 18. These relative positions of the roller mountings and carrier, which define one limit of relative pivotal motion, are shown in FIG. 3 where one roller 16 has just compressed the tube 12 along practically the entire support 14 and the other roller is just about to disengage the tube but is still compressing same and driving liquid in front of it in the direction of the arrow 36. During continued rotation of the rotor 7 by the shaft 4, liquid is sucked from a source (not shown) in the direction of the arrow 37 as the tube relaxes following compression by each roller. The tube 12 does not tend to wander during compression and is in any case confined between the parts of the limbs of each roller mountng 17, 18 that extend beyond the rollers 16.

During anti-clockwise rotation of the motor, when liquid is being pumped through the tube 12 by the rotor 7 as just described, the rotor 8 is idling, i.e. it is also rotating but without having any effect on the associated tube 13 because the carrier and roller mountings of rotor 8 are at the opposite limit of relative pivotal motion. The cause for this can best be explained by still considering the rotor 7 and what happens to it when rotated in the clockwise direction. Referring to FIGS. 5 to 7 in conjunction with FIG. 4, on commencement of clockwise rotation of the motor shaft 4 as shown by the arrow 38, the carrier 19 also turns but both the roller mountings 17 and 18 will remain momentarily stationary until the edge L–M of the cross-member or stop 30 strikes the chamfered edges or stops J–K and J1–K1 of mounting 17 and the edge N–O of the cross-member or stop 31 abuts against the chamfered edges or stops P–Q and P1–Q1 of mounting 18. Thereafter, the carrier and roller mountings of the rotor 7 will rotate in unison but its rollers 16 pass over the tube 12 without markedly compressing the tube 12 because, as will be clear from comparing FIG. 4 with FIG. 3, the rollers are effectively retracted, that is to say the circle described by the rollers 16 during clockwise rotation about the shaft 4 in FIG. 4 is smaller than during anti-clockwise rotation in FIG. 3. No pumping action takes place in the FIG. 4 condition. Of course, when the motor is reversed again, the condition of FIG. 3 is restored as soon as the carrier 19 has been turned by shaft 4 and pivoted about pins 25 relatively to the roller mountings sufficiently for its cross-members or stops 30, 31 to abut against the webs of the roller mountings.

It will now be evident that, since the rotors 7, 8 are always placed on the motor output shaft in opposite senses as previously described, each rotor will only compress its associated tube in one direction of motor rotation and only idle, with retracted rollers, in the opposite direction. It is always the rotor which has the oblique edges of its roller mountings facing in the direction of rotation that will do the pumping with its rollers extended as shown in FIG. 3. Of course it is the limited pivotal movement between the carrier and roller mountings that permits automatic extension and retraction of the rollers as described.

It ought to be mentioned that a peristaltic pump according to the invention is not restricted to the use of only two rotors and two resilient tubes. If an extra rotor were mounted on the motor shaft to co-operate with a third tube, this extra rotor would be operative, or idle, in the same respective direction as, and in unision with, one of the other two rotors. It will also be apparent that the carrier of each rotor could be modified to carry more than two pivoted roller mountings, each mounting supporting a roller for co-operating with a separate tube. Still further, each roller mounting may be constructed to support more than one roller associated with a separate tube.

It has been mentioned above that the limbs 22,23 of the roller mountings 17, 18 extend beyond the rollers 16 and that each tube 12, 13 lies against the arcuate support 14 defined in the housing 1. This is preferably so for small capacity pumps of up to about 30 l/h. For larger capacity pumps, it is probably more desirable to locate each tube in an arcuate emplacement or track defined by a channel formed in the housing or in a separate member inserted in the housing and in that case the rollers 16 will project beyond the limbs 22, 23 of the roller mountings 17, 18.

I claim:

1. A peristaltic pump comprising a single reversible motor, a shaft driven thereby, and at least two rotors turned by said shaft, said rotors respectively passing over an associated separate resiliently compressible tube when the motor is on, wherein each rotor comprises a carrier adapted to be mounted on said shaft, a plurality of separate roller mountings each pivoted to said carrier, a roller individually mounted for rotation in each roller mounting, and stop means provided on the carrier and on each roller mounting for limiting pivotal motion of said roller mountings with respect to said carrier between a first limiting position at which the rollers are extended towards the associated tube and a second limiting position at which the rollers are retracted from the associated tube, the construction being such that the rollers of a first of said at least two rotors become extended and those of a second of said at least two rotors become retracted when the shaft is turning in one direction, and vice versa when the motor is reversed.

2. A pump according to claim 1, wherein the motor-driven shaft projects into a housing which accommodates the rotors, is apertured to permit the tube associated with each rotor to enter and leave the housing, and is provided with an arcuate support for the tubes, the support being concentric with said shaft.

3. A pump according to claim 10, wherein the carrier comprises two parallel plates which are spaced apart by cross-members at opposite sides and contain aligned holes for mounting the carrier on said shaft, the cross-members constituting stops for co-operating with stops defined on the roller mountings.

4. A pump according to claim 3, wherein each roller mounting is in the form of a substantially U-shaped channel disposed between the plates of the carrier, the limbs of the channel being chamfered at one end to form oblique edges defining the said stops on the roller mountings for co-operating with one cross-member of the carrier and the channel base defining a further stop for co-operating with the other cross-member.

5. A pump according to claim 4, wherein the roller mountings of each rotor are pivoted to the carrier so that the oblique edges of the mountings of one rotor face in one direction of rotation of the motor driven shaft and the oblique edges of the mountings of another rotor face in the opposite direction of shaft rotation.

6. A pump according to claim 4, wherein the channel limbs of each roller mounting extend beyond the roller and straddle the associated tube.

* * * * *